US006479414B1

(12) United States Patent
Hauer

(10) Patent No.: US 6,479,414 B1
(45) Date of Patent: Nov. 12, 2002

(54) TEXTILE MACHINE FELT

(75) Inventor: Wolfgang Hauer, Gloggnitz (AT)

(73) Assignee: Huyck Austria GmbH, Gloggnitz (AT)

( * ) Notice: Subject to any disclaimer, the term of this patent is extended or adjusted under 35 U.S.C. 154(b) by 163 days.

(21) Appl. No.: 09/653,592

(22) Filed: Aug. 31, 2000

(51) Int. Cl.[7] ..... B32B 5/02; B32B 5/26; B32B 9/02

(52) U.S. Cl. ..... 442/326; 442/320; 442/304; 442/306; 442/319; 139/425 A; 139/383 A; 156/462; 162/109; 162/204; 162/205; 162/306; 162/358.2; 162/358.4; 162/900; 162/901; 162/902; 162/903; 162/904

(58) Field of Search ..... 442/304, 306, 442/319, 320, 326; 139/383 A, 425 A; 156/462; 162/109, 204, 205, 306, 358.2, 358.4, 900–904

(56) References Cited

U.S. PATENT DOCUMENTS

| | | | | | |
|---|---|---|---|---|---|
| 4,761,329 | A | * | 8/1988 | Halker et al. | 139/393 A |
| 4,851,281 | A | * | 7/1989 | Wood | 156/148 |
| 4,856,562 | A | * | 8/1989 | Dufour | 139/383 A |
| 4,883,097 | A | * | 11/1989 | Dufour | 139/383 A |
| 5,204,171 | A | * | 4/1993 | Eschmann | 139/383 A |
| 5,535,786 | A | * | 7/1996 | Makela et al. | 138/98 |
| 5,864,931 | A | * | 2/1999 | Best et al. | 139/383 A |
| 5,945,358 | A | * | 8/1999 | Marchand | 28/107 |

* cited by examiner

*Primary Examiner*—Terrel Morris
*Assistant Examiner*—Norca L. Torres
(74) *Attorney, Agent, or Firm*—Thomas R. Vigil; Welsh & Katz, Ltd.

(57) ABSTRACT

A textile machine felt, which can be used, for example, as a compacting felt on machines for rendering textiles shrinkproof, consists of a ground textile (1) and a felt layer (2) which is stitched thereon and comprises at least in its surface region an elastic knit fabric (3), for example, a continuous warp knitted sleeve.

8 Claims, 1 Drawing Sheet

TEXTILE MACHINE FELT

Figure 1:
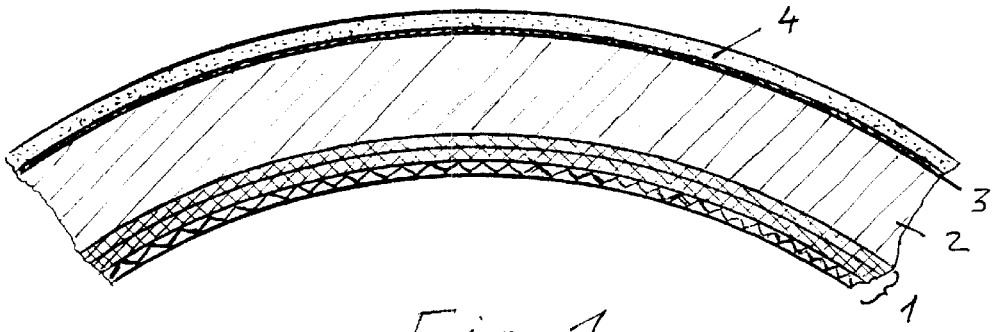

The invention relates to a textile machine felt consisting of at least one ground textile and a felt layer stitched thereon.

Textile machine felts of this type are used in particular as so-called compacting felts on special machines to render materials shrinkproof and materials which have been treated in this manner remain de facto shrinkproof during the first wash.

When using such machines, the felt must undergo several looping processes, (luring which the surface of the felt is continuously alternately stretched and then compacted. These severe movements particularly endanger the surface of the felt. Cracks can occur in the structure as far down as 5 mm in the felt and limit the serviceable life of the textile machine felt As far as the costs of the felt is concerned and the down-times associated with changing the felt, the serviceable life should be at least 1½–2 years.

It is has also been demonstrated that the serviceable life is not only reduced by the said movements but rather also by other influences on the felt, such as residue from acid dyes, bleaching agents, which are introduced into the felt from the materials to be treated, etc.

An object of the invention is to produce a textile machine felt which is better able to withstand the said effects and which as a consequence has a longer serviceable life.

This object can be achieved using a textile machine felt of the type mentioned in the introduction, where in accordance with the invention the felt layer contains at least in its surface region an elastic knit fabric.

Although this knit fabric has a stiffening and securing effect on the surface of the felt, the movement of the surface of the felt as a result of the elasticity of the knit fabric is not limited. In other words, the surface elasticity of the textile machine felt is maintained whilst the surface structure is held together.

One embodiment which has been found to be expedient in practice is characterised by the fact that the knit fabric is a continuous warp knitted sleeve.

It is also advantageous if the knit fabric consists of polyester fibres since these comply particularly well with the mechanical and chemical requirements.

It has proven to be expedient if the knit fabric is stitched onto the surface of the felt layer to form an uppermost layer since this simplifies the process of manufacturing the textile machine felt and without this the felt would have to be subjected to a stitching process where the felt layer is stitched onto the ground textile. A particular strength is achieved if the knit fabric is stitched to the felt layer using aramide fibres.

The desired strength on the one hand and the elasticity of the entire textile machine felt on the other hand are achieved if the ground textile consists of a monofilament with a multi-filament lying thereon and the ground textile is expediently a polyester fabric.

The subject of the invention is furthermore the use of a textile machine felt of the type mentioned above as a compacting felt on machines for rendering textiles shrinkproof.

Figure 2:
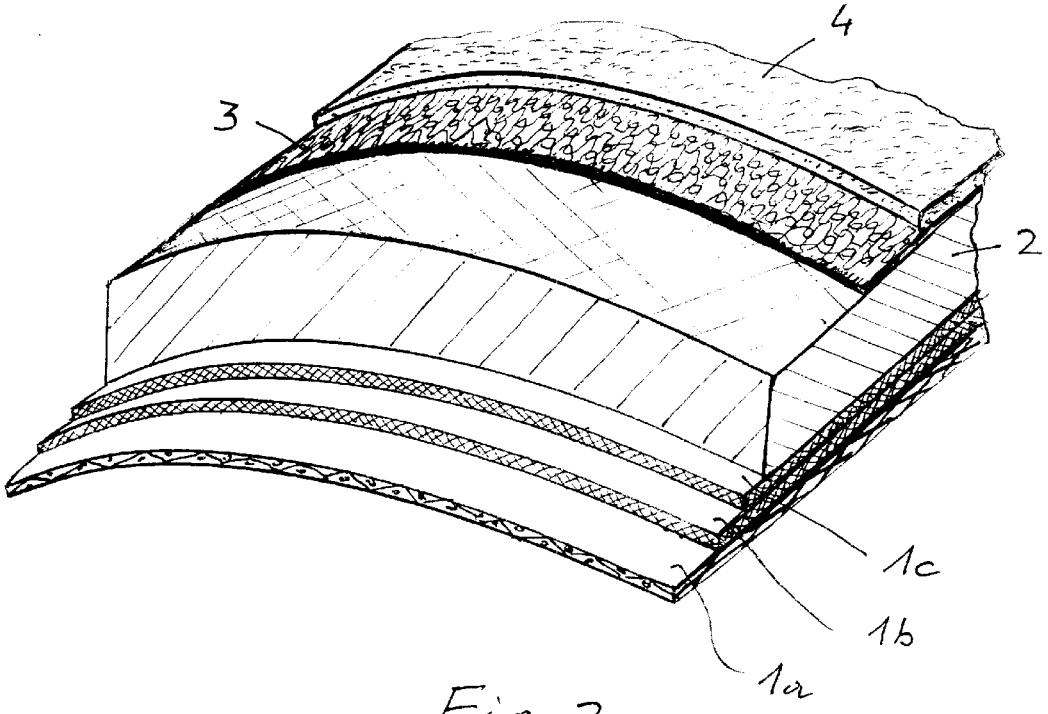

The invention and further advantages are explained in detail hereinunder with reference to an exemplified embodiment and the drawing, in which:

FIG. 1 shows a sectional view through a textile machine felt according to the invention, and FIG. 2 shows a perspective illustration of the structure of such a felt.

As FIGS. 1 and 2 show, a textile machine felt, in the special case a compacting felt, consists of a ground textile 1 and a felt layer 2 stitched thereon. In the case of an example of the invention, as illustrated here, the ground textile 1 consists of a polyester monofilament 1*a* and two layers 1*b*, 1*c* of a polyester multi-filament lying thereon.

A felt layer 2, in the present case consisting of polyester fibres, is stitched onto the ground textile 1. Methods by which felt layers are stitched on are known to the person skilled in the art and do not require to be explained further at this point. In practice, the felt layer can, for example, be 20–25 mm thick, whereas, for example, the ground textile can be 3–4 mm thick.

Within the terms of the invention, the felt layer 2 now comprises an elastic knit fabric 3, actually a warp knitted article, namely a continuous warp knitted sleeve, which can consist, for example, of polyester fibres. The knit fabric does not necessarily have to consist of synthetic material fibres, on the contrary natural fibres can also be used. The knit fabric 3 is also covered by an uppermost layer 4 which in the present case consists of aramide fibres but it is also possible to use other synthetic material fibres, for example, polyester, polyamide, polypropylene fibres and also natural fibres. As soon as the stitching of the felt layer 2 is complete or almost complete, the knit fabric 3 is placed in the form of a warp knitted sleeve quite smoothly on the previously stitched felt layer. This knit fabric 3 can now either be stitched on using fibres of the same material as the felt layer 2, i.e. pinned on or also a slightly thicker uppermost layer 4 can be applied, which can also consist of a different fibre material, as in this case aramide fibres.

The essence of the invention resides in the fact that the knit fabric 3 is completely elastic - a characteristic inherent, for example, in a warp knitted article, and as a consequence the movements of the felt surface can be achieved easily, yet the felt layer 2 is protected. In this manner, the serviceable life of the compacting felt can be considerably increased and the risk of damage, e.g. impressions on the textile to be treated, is considerably reduced.

It has been shown in practice that in place of a warp knitted article, a flat (or circular) knitted article is also extremely suitable. Furthermore, several warp knitted or flat (or circular) knitted layers can also be incorporated in various layers of the felt., e.g., also in a wound form. The use of the felt in accordance with the invention is not limited to machines for rendering textiles shrinkproof, in other words, it goes without saying, that the felt can be used anywhere where the requirements mentioned in the introduction are placed on the quality and serviceable life of the felt.

What is claimed is:

1. Textile machine felt consisting of:

at least one ground textile (1)

a felt layer (2) stitched thereon, and an elastic knit fabric (3) attached to the surface region of the felt layer.

2. Textile machine felt according to claim 1, wherein the knit fabric (3) is a continuous warp knitted sleeve.

3. Textile machine felt according to claim 1, wherein the knit fabric (3) consists of polyester fibers.

4. Textile machine felt according to claim 1, wherein the knit fabric (3) is stitched onto the surface of the felt layer (2) to form an uppermost layer.

5. Textile machine felt according to claim 4, wherein the knit fabric (3) is stitched onto the felt layer (2) using aramide fibers (4).

6. Textile machine felt according to claim 1, wherein the ground textile (1) consists of a monofilament (1*a*) with a multi-filament (1*b*) lying thereon.

7. Textile machine felt according to claim 5, wherein the ground textile (1) is a polyester fabric.

8. A compacting textile for use on machine for rendering textiles shrinkproof that comprises the textile machine felt according to claim 1.

* * * * *

UNITED STATES PATENT AND TRADEMARK OFFICE

CERTIFICATE OF CORRECTION

PATENT NO. : 6,479,414 B1
DATED : November 12, 2002
INVENTOR(S) : Wolfgang Hauer It is certified that error appears in the above-identified patent and that said Letters Patent is hereby corrected as shown below:

Title page,
Insert -- [30] Foreign Application Priority Data
SEPT 1, 1999……..(AT) A1506/99 --

Signed and Sealed this

Fifteenth Day of April, 2003

JAMES E. ROGAN
*Director of the United States Patent and Trademark Office*